US011333045B1

(12) United States Patent
Tian et al.

(10) Patent No.: US 11,333,045 B1
(45) Date of Patent: May 17, 2022

(54) FLEXIBLE COORDINATED CONTROL METHOD ADAPTED TO THERMAL POWER UNIT IN DEEP PEAK-REGULATING OPERATION

(71) Applicants: NORTH CHINA ELECTRIC POWER UNIVERSITY(BAODING), Baoding (CN); STATE GRID LIAONING ELECTRIC POWER CO., LTD., Shenyang (CN)

(72) Inventors: Liang Tian, Baoding (CN); Xinping Liu, Baoding (CN); Bo Hu, Shenyang (CN); Tuoyu Deng, Baoding (CN); Zhimin Guan, Baoding (CN); Guiping Zhou, Shenyang (CN); Shunjiang Wang, Shenyang (CN); Lei Wang, Shenyang (CN)

(73) Assignees: NORTH CHINA ELECTRIC POWER UNIVERSITY(BAODING), Baoding (CN); STATE GRID LIAONING ELECTRIC POWER CO., LTD., Shenyang (CN)

( * ) Notice: Subject to any disclaimer, the term of this patent is extended or adjusted under 35 U.S.C. 154(b) by 0 days.

(21) Appl. No.: 17/609,787

(22) PCT Filed: Nov. 20, 2020

(86) PCT No.: PCT/CN2020/130423

§ 371 (c)(1),
(2) Date: Nov. 9, 2021

(87) PCT Pub. No.: WO2022/062145

PCT Pub. Date: Mar. 31, 2022

(30) Foreign Application Priority Data

Sep. 24, 2020 (CN) ..... 202011019684.1

(51) Int. Cl.
*F01K 13/02* (2006.01)
*F22B 35/18* (2006.01)
*F01D 17/04* (2006.01)

(52) U.S. Cl.
CPC ..... *F01K 13/02* (2013.01); *F01D 17/04* (2013.01); *F22B 35/18* (2013.01); *F05D 2220/31* (2013.01); *F05D 2270/053* (2013.01)

(58) Field of Classification Search
CPC ..... F01K 13/02; F01D 17/04; F05D 2220/31; F05D 2270/053; F22B 35/18
See application file for complete search history.

(56) References Cited

U.S. PATENT DOCUMENTS 6,192,837 B1 * 2/2001 Wittchow ..... F22B 35/14 122/451 S
8,820,078 B1 * 9/2014 Duffy ..... F22B 1/00 60/657

(Continued)

FOREIGN PATENT DOCUMENTS

CN 102629131 A 8/2012
CN 106773669 A 5/2017
CN 106773669 A * 5/2017 ..... G05B 13/042

OTHER PUBLICATIONS

English Translation CN_106773669_A_I.pdf (Year: 2017).*

(Continued)

*Primary Examiner* — Shafiq Mian
(74) *Attorney, Agent, or Firm* — Bayramoglu Law Offices LLC

(57) ABSTRACT

A flexible coordinated control method adapted to a thermal power unit in a deep peak-regulating operation includes: adding a reverse compensation channel from a fuel quantity instruction to a power generation load instruction on a basis of a traditional coordinated control system of a boiler-following mode; meanwhile, constructing a flexible factor (Continued)

by using a main steam flow quantity signal, and correcting a gain of the reverse compensation channel by the flexible factor in a product mode to obtain a reverse power generation load instruction bias value; and correcting the power generation load instruction of the unit by using the reverse power generation load instruction bias value, so as to give priority to guaranteeing the control quality of a power generation load and a throttle pressure before a steam turbine under conventional load conditions and give priority to guaranteeing the combustion stability under deep peak-regulating conditions.

8 Claims, 3 Drawing Sheets

(56) References Cited

U.S. PATENT DOCUMENTS

| | | | | |
|---|---|---|---|---|
| 9,845,710 | B2 * | 12/2017 | Ichinose | F01K 7/025 |
| 2010/0072293 | A1 * | 3/2010 | Flynn | F24D 19/1003 237/9 R |
| 2017/0016173 | A1 * | 1/2017 | Estrada | D06F 75/26 |
| 2018/0130143 | A1 * | 5/2018 | Han | G06Q 50/06 |
| 2019/0348937 | A1 | 11/2019 | Goi et al. | |

OTHER PUBLICATIONS

Wang Shuyun, et al., Robust Optimal Dispatch of Large-scale Wind Power Integration Considering Deep Peak Regulation Cost of Thermal Power Units, Automation of Electric Power Systems, 2020, pp. 118-125, vol. 44, No. 1.

* cited by examiner

FLEXIBLE COORDINATED CONTROL METHOD ADAPTED TO THERMAL POWER UNIT IN DEEP PEAK-REGULATING OPERATION

CROSS REFERENCE TO THE RELATED APPLICATIONS

This application is the national phase entry of International Application No. PCT/CN2020/130423, filed on Nov. 20, 2020, which is based upon and claims priority to Chinese Patent Application No. 202011019684.1, filed on Sep. 24, 2020, the entire contents of which are incorporated herein by reference.

TECHNICAL FIELD

The present invention relates to a control method of a thermal power unit, which is adapted to the thermal power unit required to perform deep peak-regulating operation, belonging to the field of power generation technology.

BACKGROUND

Under the current technical conditions, it is difficult to store electric energy on a large scale, so the power grid needs to improve the dispatching flexibility of thermal power generation load to eliminate a double random disturbance caused by a power consumption load and the large-scale grid connection of a renewable energy power generation load represented by wind power and maintain grid frequency stability. The main technical method for improving the flexibility of the thermal power unit is to broaden a regulation range of the power generation load, and the key is to reduce the lower limit of the power generation load of the unit in operation from the current 50% Pe (rated power generation load) to 40% Pe, 30% Pe or even lower, so as to realize the deep peak-regulating operation and make room for wind power generation load.

There are many problems in the deep peak-regulating operation of the thermal power unit, such as a decrease of thermal cycle efficiency, a decrease of denitrification efficiency, an increase of the power consumption of auxiliary generator and the like, but the most serious is the reduction of boiler combustion stability so that extinguishing of boiler fire and other safety accidents are liable to occur. According to statistics, the two main controllable factors that cause the extinguishing of the boiler fire are the excessively low amount and the fluctuation of fuel quantity. The reasons are as follows. Firstly, the combustion of pulverized coal stream in the boiler is a process of absorbing heat first and then releasing heat, and the obtainable heat absorption mainly depends on the average combustion temperature in a boiler chamber. The boiler thermal calculation shows that the average combustion temperature decreases rapidly with the decrease of the fuel quantity. When the combustion temperature is excessively low and the pulverized coal stream cannot catch fire due to insufficient heat absorption, it will cause the extinguishing of the boiler fire. Secondly, in order to satisfy the transportation requirements of the pulverized coal, the air volume in single time is not allowed to be lower than a certain low limit, so that there will be more wind but less coal, and less pulverized coal concentration during the deep peak-regulating operation, which causes the difficult ignition of the pulverized coal stream. In addition, the fluctuation of the fuel quantity leads to the unstable operation state of the boiler pulverizing system, and further results in the instability of pulverized coal stream entering the boiler chamber. For example, when the feeding amount of coal increases suddenly, a large amount of coarse-grained coal enters the coal mill to produce the pressing and grinding effect, and the output amount of pulverized coal decreases instantaneously, which will cause the extinguishing of fire due to excessively low pulverized coal concentration. For example, during the fluctuation of the fuel quantity, the ratio of wind to coal is liable to be dynamically mismatched, and this will also cause the extinguishing of fire due to the excessively low pulverized coal concentration occurring instantaneously.

The coordinated control system of the thermal power unit is mainly configured to adjust the power generation load of the unit and the throttle pressure before the steam turbine by controlling the opening degree of the steam inlet valve of the steam turbine and the fuel quantity, so as to make it change by following the instructions. Under the conventional load conditions, the main goal of the coordinated control system is to guarantee the control quality of the power generation load and the main steam pressure, while under the deep peak-regulating conditions, the main goal needs to be changed to guarantee the combustion stability, namely, to prevent the fuel quantity from being excessively low and reduce the fluctuation of the fuel quantity. However, the traditional coordinated control system is only designed for the conventional load conditions of the thermal power unit, which cannot satisfy the requirements of deep peak-regulating operation.

For the controlled object with large inertia feature, there is a contradiction between the output action amplitude of the controller and the control quality of the controlled variable. It is necessary to increase the output action amplitude of the controller for improving the control quality, and limiting the output action amplitude of the controller will reduce the control quality of the controlled variables. The controlled object of the coordinated control system also has large inertia feature, and the primary goal of the deep peak-regulating of the unit is stable operation under low load. Therefore, it is required to more focus on reducing the fluctuation of the fuel quantity, while the requirements for the control quality of the power generation load and the main steam pressure are allowed to be appropriately reduced.

Theoretically, this goal can be achieved by weakening the regulation intensity of the controller. However, the coordinated control system includes a boiler-specific main control loop and a steam turbine-specific main control loop, and each control loop contains many adjustable parameters, such as static feedforward of set value, dynamic feedforward of set value, proportional-integral-differential feedback and others. In addition, a lot of variable parameter compensation logic has been included in order to adapt to the change of the controlled object. It is required to add more variable parameter logic in order to adapt to the deep peak-regulating operation and change the regulation intensity, so it is difficult to perform on-site configuration, debugging and maintenance.

SUMMARY

An objective of the present invention is to provide a flexible coordinated control method adapted to a thermal power unit in a deep peak-regulating operation, which can satisfy the control requirements of the thermal power unit under both conventional load conditions and deep peak-regulating conditions, thereby ensuring the control effect under various working conditions.

In order to solve the above problems, the present invention adopts the following technical solutions.

A flexible coordinated control method adapted to a thermal power unit in deep peak-regulating operation, includes: adding a reverse compensation channel from a fuel quantity instruction to a power generation load instruction on a basis of a traditional coordinated control system of a boiler-following mode; meanwhile, constructing a flexible factor by using a main steam flow quantity signal, and correcting a gain of the reverse compensation channel by the flexible factor in a product mode to obtain a reverse power generation load instruction bias value; and correcting the power generation load instruction of the unit by using the reverse power generation load instruction bias value, so as to give priority to guaranteeing the control quality of a power generation load and a throttle pressure before a steam turbine under conventional load conditions and give priority to guaranteeing the combustion stability under deep peak-regulating conditions.

According to the flexible coordinated control method adapted to the thermal power unit in the deep peak-regulating operation, the reverse compensation channel is provided with a change rate limiting module RL, a constant module A, a high and low amplitude limiting module H//L, a multiplication calculation module MUL, and four summation calculation modules; a fuel quantity instruction signal is disposed by the change rate limiting module RL to obtain a fuel quantity instruction signal with a limited change rate, and then the fuel quantity instruction signal is subtracted by the fuel quantity instruction signal with the limited change rate through a first summation calculation module SUM1 to obtain a component signal where the fuel quantity instruction signal exceeds an allowable change rate. A fuel quantity signal corresponding to a boiler-specific minimum stable combustion load outputted by the constant module A is subtracted by the fuel quantity instruction signal through a second summation calculation module SUM2 to obtain a deviation, and an amplitude of the deviation is limited through the high and low amplitude limiting module H//L to obtain a component signal where the fuel quantity instruction is lower than a minimum fuel quantity. The component signal where the fuel quantity instruction signal exceeds the allowable change rate and the component signal where the fuel quantity instruction is lower than the minimum fuel quantity are summed through a third summation calculation module SUM3 to obtain a fuel quantity instruction change compensation signal. The fuel quantity instruction change compensation signal is multiplied with a flexible factor compensation coefficient through the multiplication calculation module MUL to obtain a power generation load instruction bias signal. An original power generation load fixed value signal is subtracted by the power generation load instruction bias signal through a fourth summation calculation module SUM4 to obtain a final new power generation load fixed value signal.

According to the flexible coordinated control method adapted to the thermal power unit in the deep peak-regulating operation, the flexible factor compensation coefficient is constructed by a first-order inertia filter module LAG, a multi-point broken line function module F(x), and a gain calculation module K. A boiler-specific main steam flow quantity signal is filtered by the first-order inertia filter module LAG, and is then disposed by the multi-point broken line function module F(x) to obtain a flexible factor signal. After a gain of the flexible factor signal is adjusted by the gain calculation module K, the flexible factor compensation coefficient is finally obtained.

According to the flexible coordinated control method adapted to the thermal power unit in the deep peak-regulating operation, the high limited amplitude of the high and low amplitude limiting module is $0.1\times q_{ce}$, and the low limited amplitude of the high and low amplitude limiting module is 0, wherein $q_{ce}$ is a rated fuel quantity of the unit.

According to the flexible coordinated control method adapted to the thermal power unit in the deep peak-regulating operation, parameters of the multi-point broken line function module F(x) are as follows:

when inputs are $0.0\times q_{mse}$, $0.39\times q_{mse}$, $0.45\times q_{mse}$, $0.5\times q_{mse}$, $1.0\times q_{mse}$, and $1.5\times q_{mse}$, outputs are 1, 1, 0.7, 0, 0, and 0, respectively, where $q_{mse}$ is a rated main steam flow quantity of the unit.

According to the flexible coordinated control method adapted to the thermal power unit in the deep peak-regulating operation, a range of the flexible factor is 0-1.

According to the flexible coordinated control method adapted to the thermal power unit in the deep peak-regulating operation, a filtering time of the first-order inertia filter module LAG is set to 100 s.

In the present invention, a change rate and a downward change amplitude of the fuel quantity instruction are reduced through the reverse compensation channel from the fuel quantity instruction to the power generation load instruction, so as to give priority to guaranteeing the control quality of a power generation load and a throttle pressure before a steam turbine under a conventional load range, while giving priority to guaranteeing the combustion stability under a deep peak-regulating load range, which ensures the control effect under various working conditions and satisfies the control requirements of the thermal power unit under conventional load conditions and deep peak-regulating conditions.

BRIEF DESCRIPTION OF THE DRAWINGS

The present invention is further described in detail in combination with the drawings below.

In the figures: SUM1-SUM4: first summation calculation module to fourth summation calculation module; RL: change rate limiting module; A: constant module; H//L: high and low amplitude limiting module; MUL: multiplication calculation module; LAG: first-order inertia filter module; F(x): multi-point broken line function module; K: gain calculation module.

DETAILED DESCRIPTION OF THE EMBODIMENTS

In view of the deficiency that the prior coordinated control system is incapable of simultaneously meet the situation of giving priority to guaranteeing the control quality of power generation load and the throttle pressure before the steam turbine under conventional load conditions, and the situation of giving priority to guaranteeing the combustion stability under deep peak-regulating load conditions, the present invention provides a flexible coordinated control system adapted to a thermal power unit in deep peak-regulating operation. The main features are as follows: on the basis of a traditional coordinated control system of a boiler-following mode, a reverse compensation channel from a fuel quantity instruction to a power generation load instruction is added; a flexible factor is constructed by using a main steam flow quantity signal, and the gain of the reverse compensation channel is corrected by the flexible factor in a product mode; the compensation channel outputs the reverse generation load instruction bias value to correct the power generation load instruction of the unit; by using the closed-loop regulation feature of the coordinated control system of the boiler-following mode to take the cost of reducing the control indexes of the power generation load and the throttle pressure before the steam turbine, the change rate and the downward change amplitude of the fuel quantity instruction are reduced. The following technical objectives can be achieved: under conventional load conditions, the flexible control system gives priority to guaranteeing the control quality of the power generation load and the throttle pressure before the steam turbine; under the deep peak-regulating conditions of the unit, when the change rate of the fuel quantity instruction exceeds the allowable fuel quantity change rate in the deep peak-regulating conditions and the fuel quantity instruction is less than the fuel quantity corresponding to the minimum stable combustion load, the control system will automatically reduce the change amplitude of the fuel quantity to ensure combustion stability.

Technical Principle

Figure 1:
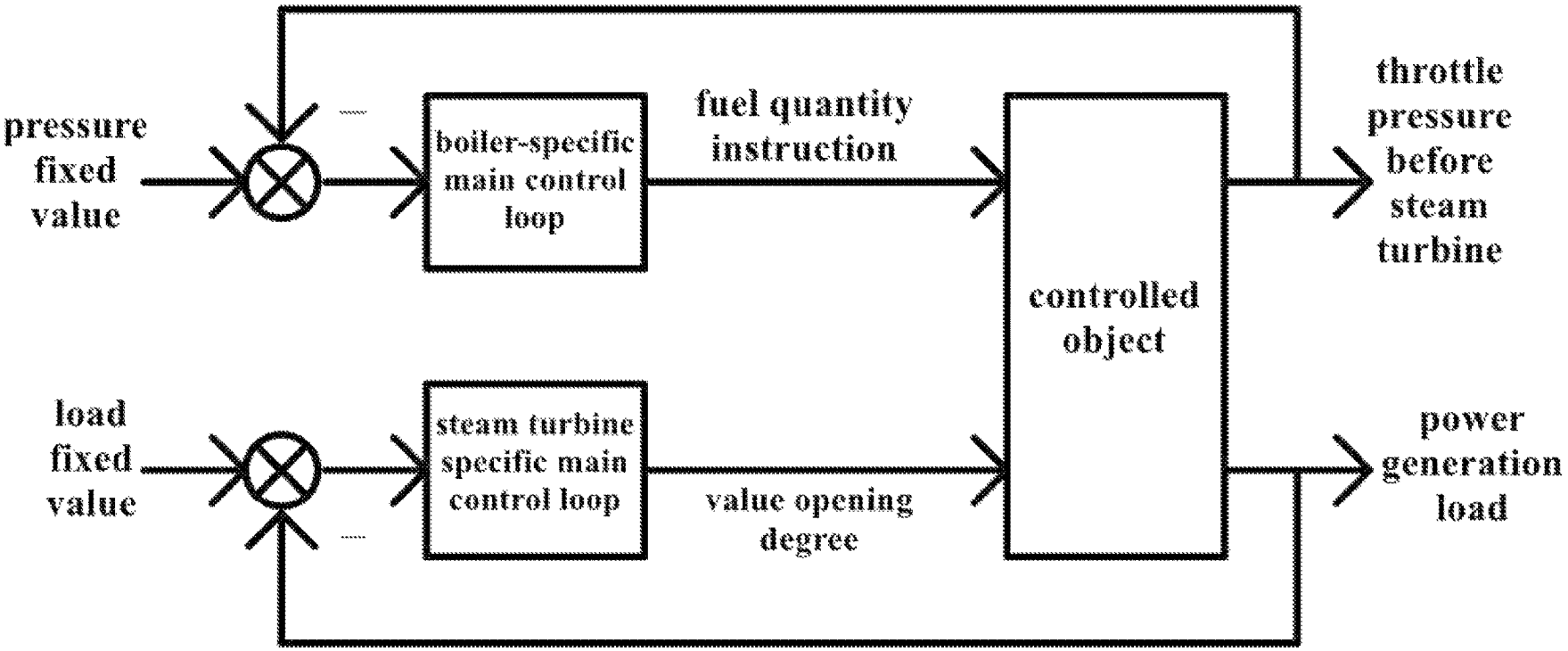
FIG. 1 is a structural block diagram of the traditional coordinated control system of a boiler-following mode.

FIG. 1 shows a structural block diagram of the traditional coordinated control system of the boiler-following mode. The basic features are as follows: the deviation obtained by the load fixed value signal minus the power generation load signal enters the steam turbine-specific main control loop, and the valve opening degree instruction signal of the steam turbine is output to control the power generation load; the deviation obtained by the pressure fixed value signal minus the throttle pressure signal before the steam turbine enters the boiler-specific main control loop, and the fuel quantity instruction signal is output to control the throttle pressure before the steam turbine.

Figure 2:
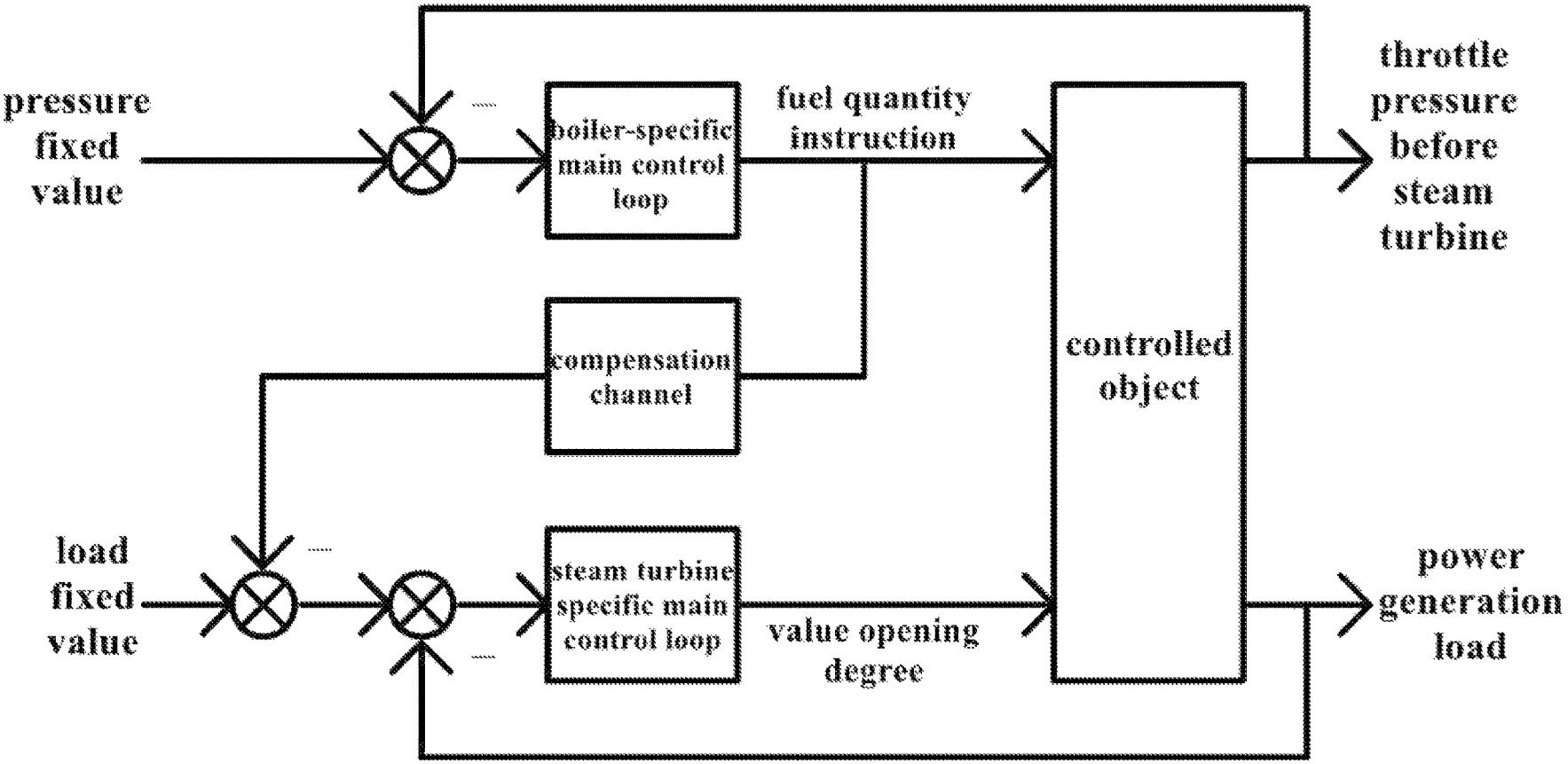
FIG. 2 is the structural block diagram of a flexible coordinated control system.

FIG. 2 shows a structural block diagram of the flexible coordinated control system adapted to deep peak-regulating operation. The main feature is to add the reverse compensation channel from the fuel quantity instruction signal to the power generation load instruction fixed value. The working mechanism is as follows: when the fuel quantity instruction increases, a power generation load instruction bias value is reversely superimposed on the original power generation load instruction fixed value of the unit according to a certain proportion, so that the superimposed power generation load instruction is decreased. In this way, under the regulation of the steam turbine-specific main control loop, the valve opening degree instruction is decreased, the power generation load is decreased and the throttle pressure before the steam turbine is increased, and then the fuel quantity instruction is decreased under the action of the boiler-specific main control loop. On the contrary, when the fuel quantity instruction decreases, a power generation load instruction bias value is reversely superimposed on the original power generation load instruction fixed value of the unit according to a certain proportion, so that the superimposed power generation load instruction is increased. In this way, under the regulation of the steam turbine-specific main control loop, the valve opening degree instruction is increased, the power generation load is increased and the throttle pressure before the steam turbine is decreased, and then the fuel quantity instruction is increased under the action of the boiler-specific main control loop. Therefore, this reverse compensation channel is equivalent to adding a negative feedback loop in the coordinated control system to restrict the change of the fuel quantity, which can automatically correct the power generation load and the throttle pressure before the steam turbine to reduce the fluctuation of fuel quantity when the fuel quantity fluctuates.

The essence of flexible coordinated control is to reduce the fluctuation amplitude of fuel quantity at the cost of reducing the control quality of the power generation load and the throttle pressure before the steam turbine. However, the advantage is that the reduction amplitude of the control quality of the power generation load and the throttle pressure before the steam turbine is controllable. On one hand, this compensation loop determines the quantitative correspondence between the change amplitude of fuel quantity and the deviation of power generation load, and the physical significance of the gain and loss is clear. On the other hand, the negative feedback introduced by adding the compensation loop improves the overall stability of the control system.

Technical Solution

Figure 3:
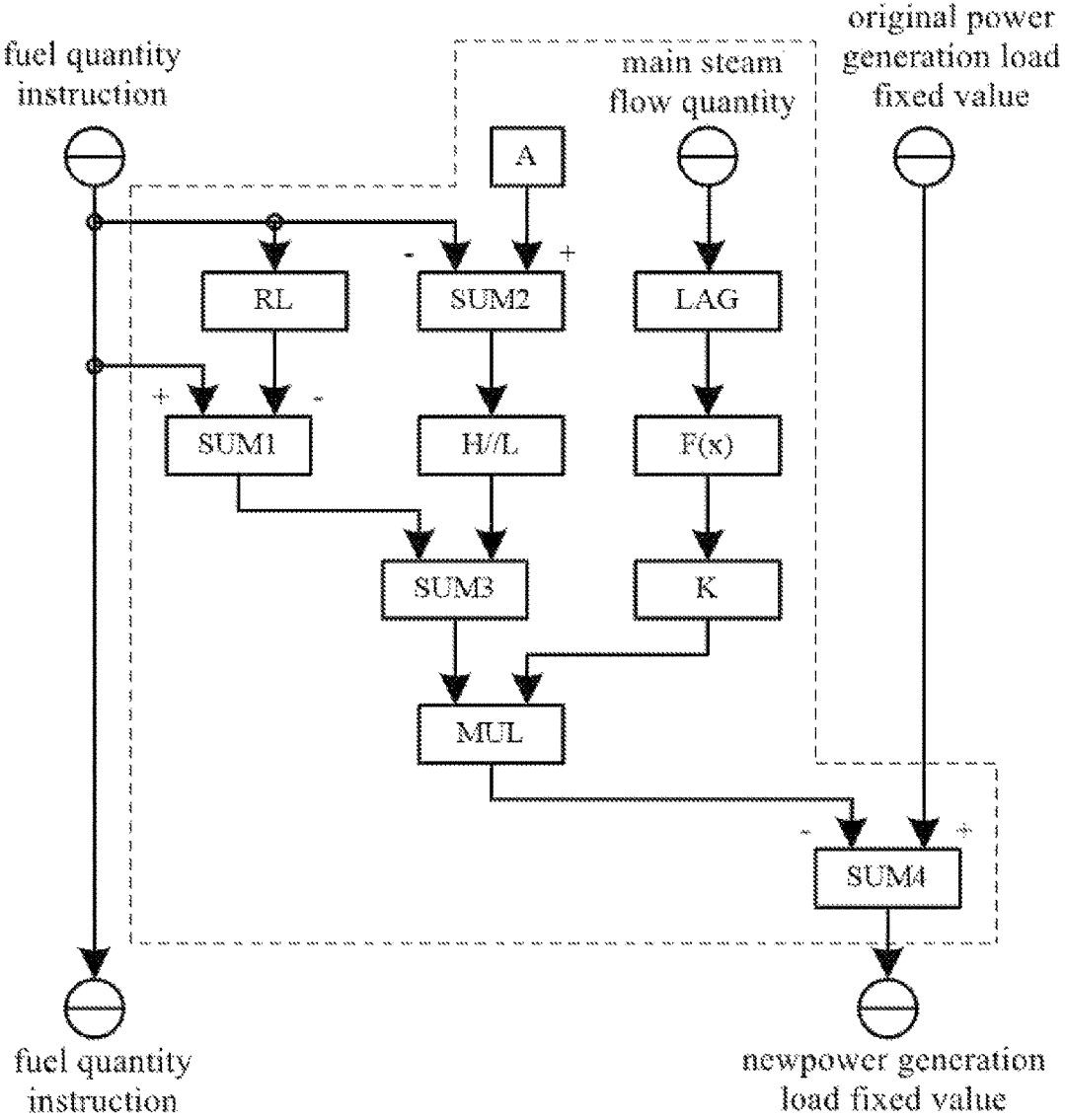
FIG. 3 is a schematic diagram of the newly added logic of the flexible coordinated control system.

A flexible coordinated control system adapted to a thermal power unit in deep peak-regulating operation is formed by adding the logic of the compensation channel shown in FIG. 3 on the basis of an original coordinated control system of a boiler-following mode, and the logic in the dotted frame in FIG. 3 is newly added. Specifically, SUM1-SUM4 are four summation calculation modules; RL is the change rate limiting module, and has the function of limiting the change rate of the input signal within the limit value and then outputting; A is the constant module; H//L is the high and low amplitude limiting module, and has the function of limiting the change amplitude of the input signal within the high and low limit values and then outputting; MUL is the multiplication calculation module; LAG is the first-order inertia filter module; F(x) is the multi-point broken line function module; and K is the gain calculation module.

The compensation channel logic includes a fuel quantity instruction change calculation logic and a flexible factor gain correction logic.

Firstly, the fuel quantity instruction change calculation logic is explained. A fuel quantity instruction signal is disposed by the change rate limiting module RL to obtain a fuel quantity instruction signal with a limited change rate. The fuel quantity instruction signal is subtracted by the fuel quantity instruction signal with the limited change rate through the first summation calculation module SUM1 to obtain a component signal where the fuel quantity instruction signal exceeds an allowable change rate. A fuel quantity signal corresponding to the boiler-specific minimum stable combustion load is output by the constant module A, and is then subtracted by the fuel quantity instruction signal through the second summation calculation module SUM2 to obtain the deviation. The amplitude of the deviation is limited through the high and low amplitude limiting module H//L to obtain a component signal where the fuel quantity instruction is lower than the minimum fuel quantity. The component signal where the fuel quantity instruction signal exceeds the allowable change rate and the component signal where the fuel quantity instruction is lower than the minimum fuel quantity are summed through the third summation calculation module SUM3 to obtain a fuel quantity instruction change compensation signal.

Secondly, the flexible factor gain correction logic is described. A boiler-specific main steam flow quantity signal is filtered by the first-order inertia filter module LAG, and then a flexible factor signal is calculated by the multi-point broken line function module F(x) using multi-point function. The gain of the flexible factor signal is adjusted by the module K, and is then multiplied with the fuel quantity instruction change compensation signal through the multiplication calculation module MUL to obtain a power generation load instruction bias signal.

The load fixed value signal in the original control logic is subtracted by the power generation load instruction bias signal through the fourth summation calculation module SUM4 to obtain a new power generation load fixed value signal.

The working principle of the compensation channel logic is as follows.

Under the deep peak-regulating condition of the unit, the allowable fuel quantity change rate does not exceed 0.01 $q_{ce}$/min, where $q_{ce}$ is the rated fuel quantity of the unit. The change rate limit value of the change rate limiting module RL is set to the allowable fuel quantity change rate under the deep peak-regulating condition of the unit, and then the fuel quantity instruction signal is subtracted by the fuel quantity instruction signal with the limited change rate to obtain the component signal where the fuel quantity instruction signal exceeds the allowable change rate (i.e., the component signal where the fuel quantity instruction rapidly changes). When the fuel quantity instruction signal change rate is less than the allowable value, the component signal where the fuel quantity instruction rapidly changes is 0. When the fuel quantity instruction signal change rate is greater than the allowable value, the component signal where the fuel quantity instruction signal exceeds the allowable change rate is not 0, which has a physical significance that the fuel quantity instruction change exceeds the allowable change amplitude. The output of the constant module A is set to the fuel quantity corresponding to the minimum stable combustion load of the unit, and is subtracted by the fuel quantity instruction signal to obtain a difference. The amplitude of the difference is limited to obtain the component signal where the fuel quantity instruction is less than the minimum fuel quantity. The high and low limited amplitude values of the high and low amplitude limiting module HA are shown in Table 1. When the fuel quantity instruction signal is greater than or equal to the minimum fuel quantity, the component signal where the fuel quantity instruction is less than the minimum fuel quantity is 0, and when the fuel quantity instruction signal is less than the minimum fuel quantity, the component signal where the fuel quantity instruction is less than the minimum fuel quantity is the part where the fuel quantity instruction is less than the minimum fuel quantity. In order to prevent the large fluctuation of the power generation load instruction caused by the abnormal fuel quantity instruction, the variation range of the component signal where the fuel quantity instruction is less than the minimum fuel quantity is limited to 0-0.1 $q_{ce}$. The fuel quantity instruction change compensation signal is obtained by summing the component signal where the fuel quantity instruction signal exceeds the allowable change rate and the component signal where the fuel quantity instruction signal is lower than the minimum fuel quantity. When the fuel quantity instruction change rate is excessively high and the fuel quantity instruction is excessively low, the output of the fuel quantity instruction change compensation signal will be greater than 0.

TABLE 1

| Parameter setting of the HA module | |
|---|---|
| High limit value (t/h) | 0.1 × $q_{ce}$ |
| Low limit value (t/h) | 0 |

The flexible factor is constructed by using the main steam flow quantity signal which can directly reflect the load of the unit. The range of the flexible factor is 0-1, where 0 represents that the unit is in the conventional load range, and 1 represents that the unit is in the deep peak-regulating load range, and the change between 0-1 represents that the unit is in the transition range from the conventional load to the deep peak-regulating load. First of all, the main steam flow quantity signal is filtered by first-order inertia filter, and the filtering time is 100 s. Then, the flexible factor signal is calculated by using the multi-point broken line function. The setting mode of the multi-point broken line function module F(x) is shown in Table 2, where $q_{mse}$ is the rated main steam flow quantity of the unit. Finally, the gain of the flexible factor is adjusted, and is then multiplied with the fuel quantity instruction change compensation signal to obtain the load instruction bias signal. When the unit is in the conventional load range, the flexible factor signal is 0, the load instruction bias signal is 0, and the compensation logic does not play a regulating role. When the unit is in the deep peak-regulating load range, the flexible factor signal is 1, the compensation logic plays a complete regulating role. When the unit is in the transition range from the conventional load to the deep peak-regulating load, the compensation logic plays a partial regulating role, and the regulating effect increases as the load approaches the deep peak-regulating load range.

TABLE 2

| Parameter setting of F(x) | | | | | | |
|---|---|---|---|---|---|---|
| | Broken line points | | | | | |
| | 1 | 2 | 3 | 4 | 5 | 6 |
| Input (t/h) | 0.0 × $q_{mse}$ | 0.39 × $q_{mse}$ | 0.45 × $q_{mse}$ | 0.5 × $q_{mse}$ | 1.0 × $q_{mse}$ | 1.5 × $q_{mse}$ |
| Output (Dimensionless) | 1 | 1 | 0.7 | 0 | 0 | 0 |

The gain of the flexible factor signal is the only parameter that needs to be debugged in the control system, and the debugging is realized by setting a gain coefficient in the gain calculation module K. The range of the gain coefficient is 1-2 times of a quotient obtained through dividing the power generation load under static working conditions of the unit by the fuel quantity. The fluctuation amplitude of the fuel quantity decreases as the gain coefficient increases, but the control quality of the power generation load and the throttle pressure before the steam turbine decreases.

Implementation Steps (1) Confirmation of Implementation Conditions

The present invention is suitable for the thermal power unit in deep peak-regulating operation, matching pulverized coal boilers or circulating fluidized bed boilers, and adopting the coordinated control system of the boiler-following mode.

(2) Control Logic Modification and Parameter Setting

In the distributed control system (DSC) of the unit, on the basis of the configuration logic of the original coordinated control system, the configuration logic of the reverse compensation channel from the fuel quantity instruction to the power generation load fixed value is added according to FIG. 3.

The parameters of the main modules in the logic are set as follows: the limit value of the change rate limiting module RL is set to be 0.01 times as much as the rated fuel quantity of the unit per minute; the output of the constant module A is set to the fuel quantity corresponding to the minimum stable combustion load of the unit; the high and low limit values of the high and low amplitude limiting module H//L are set as shown in Table 1; the filtering time of the first-order inertia filter module LAG is set to 100 s; the parameter setting of the multi-point broken line function module F(x) is shown in Table 2.

(4) Parameter Debugging

Under the normal operating condition of the unit, the output values of the multi-point broken line function module F(x) are all set to 1, and the gain coefficient in the gain calculation module K is debugged. The range of the gain coefficient is 1-2 times of the quotient obtained through dividing the power generation load under static working conditions of the unit by the fuel quantity. The fluctuation amplitude of the fuel quantity decreases as the gain coefficient increases, but the control quality of the power generation load and the throttle pressure before the steam turbine decreases. After debugging, the output values of the multi-point broken line function module F(x) are amended according to the setting mode of Table 2, and then the system can be put into utilization.

Advantages (1) Favorable control effect: the present invention provides the flexible coordinated control system, which can give priority to guaranteeing the control quality of the power generation load and the throttle pressure before the steam turbine in the conventional load range, and can give priority to guaranteeing the combustion stability by reducing the fluctuation of the fuel quantity in the deep peak-regulating load range, so as to satisfy the requirements of the current thermal power units in the deep peak-regulating operation and obtain the favorable control effect.

(2) The system has few adjustable parameters, simple structure and clear physical significance, and the on-site debugging of the system is simple and fast.

(3) The system has a favorable stability, and a low risk during debugging.

What is claimed is:

1. A flexible coordinated control method adapted to a thermal power unit in a deep peak-regulating operation, comprising: adding a reverse compensation channel from a fuel quantity instruction to a power generation load instruction on a basis of a traditional coordinated control system of a boiler-following mode; meanwhile, constructing a flexible factor by using a main steam flow quantity signal, and correcting a gain of the reverse compensation channel by the flexible factor in a product mode to obtain a reverse power generation load instruction bias value; and correcting the power generation load instruction of the thermal power unit by using the reverse power generation load instruction bias value, so as to give priority to guaranteeing a control quality of a power generation load, and a throttle pressure before a steam turbine under conventional load conditions and give priority to guaranteeing a combustion stability under deep peak-regulating conditions.

2. The flexible coordinated control method adapted to the thermal power unit in the deep peak-regulating operation according to claim 1, wherein the reverse compensation channel is provided with a change rate limiting module (RL), a constant module (A), a high and low amplitude limiting module (H//L), a multiplication calculation module (MUL), and four summation calculation modules; a fuel quantity instruction signal is disposed by the change rate limiting module (RL) to obtain a fuel quantity instruction signal with a limited change rate, and then the fuel quantity instruction signal is subtracted by the fuel quantity instruction signal with the limited change rate through a first summation calculation module (SUM1) to obtain a component signal where the fuel quantity instruction signal exceeds an allowable change rate; a fuel quantity signal corresponding to a boiler-specific minimum stable combustion load outputted by the constant module (A) is subtracted by the fuel quantity instruction signal through a second summation calculation module (SUM2) to obtain a deviation, and an amplitude of the deviation is limited through the high and low amplitude limiting module (H//L) to obtain a component signal where the fuel quantity instruction is lower than a minimum fuel quantity; the component signal where the fuel quantity instruction signal exceeds the allowable change rate and the component signal where the fuel quantity instruction is lower than the minimum fuel quantity are summed through a third summation calculation module (SUM3) to obtain a fuel quantity instruction change compensation signal; the fuel quantity instruction change compensation signal is multiplied with a flexible factor compensation coefficient through the multiplication calculation module (MUL) to obtain a power generation load instruction bias signal; an original power generation load fixed value signal is subtracted by the power generation load instruction bias signal through a fourth summation calculation module (SUM4) to obtain a final new power generation load fixed value signal.

3. The flexible coordinated control method adapted to the thermal power unit in the deep peak-regulating operation according to claim 1, wherein a flexible factor compensation coefficient is constructed by a first-order inertia filter module (LAG), a multi-point broken line function module (F(x)), and a gain calculation module (K); a boiler-specific main steam flow quantity signal is filtered by the first-order inertia filter module (LAG), and is then disposed by the multi-point broken line function module (F(x)) to obtain a flexible factor signal; after a gain of the flexible factor signal is adjusted by the gain calculation module (K), the flexible factor compensation coefficient is finally obtained.

4. The flexible coordinated control method adapted to the thermal power unit in the deep peak-regulating operation according to claim 3, wherein a high limited amplitude of the high and low amplitude limiting module is $0.1\times q_{ce}$, and a low limited amplitude of the high and low amplitude limiting module is 0, wherein $q_{ce}$ is a rated fuel quantity of the thermal power unit.

5. The flexible coordinated control method adapted to the thermal power unit in the deep peak-regulating operation according to claim 4, wherein parameters of the multi-point broken line function module (F(x)) are as follows:

when inputs are $0.0\times q_{mse}$, $0.39\times q_{mse}$, $0.45\times q_{mse}$, $0.5\times q_{mse}$, $1.0\times q_{mse}$, and $1.5\times q_{mse}$, outputs are 1, 1, 0.7, 0, 0, and 0, respectively, wherein $q_{mse}$ is a rated main steam flow quantity of the thermal power unit.

6. The flexible coordinated control method adapted to the thermal power unit in the deep peak-regulating operation according to claim 5, wherein a range of the flexible factor is 0-1.

7. The flexible coordinated control method adapted to the thermal power unit in the deep peak-regulating operation according to claim 3, wherein a filtering time of the first-order inertia filter module (LAG) is set to 100 s.

8. The flexible coordinated control method adapted to the thermal power unit in the deep peak-regulating operation according to claim 3, wherein the reverse compensation channel is provided with a change rate limiting module (RL), a constant module (A), a high and low amplitude limiting module (H//L), a multiplication calculation module (MUL), and four summation calculation modules; a fuel quantity instruction signal is disposed by the change rate limiting module (RL) to obtain a fuel quantity instruction signal with a limited change rate, and then the fuel quantity instruction signal is subtracted by the fuel quantity instruction signal with the limited change rate through a first summation calculation module (SUM1) to obtain a component signal where the fuel quantity instruction signal exceeds an allowable change rate; a fuel quantity signal corresponding to a boiler-specific minimum stable combustion load outputted by the constant module (A) is subtracted by the fuel quantity instruction signal through a second summation calculation module (SUM2) to obtain a deviation, and an amplitude of the deviation is limited through the high and low amplitude limiting module (H//L) to obtain a component signal where the fuel quantity instruction is lower than a minimum fuel quantity; the component signal where the fuel quantity instruction signal exceeds the allowable change rate and the component signal where the fuel quantity instruction is lower than the minimum fuel quantity are summed through a third summation calculation module (SUM3) to obtain a fuel quantity instruction change compensation signal; the fuel quantity instruction change compensation signal is multiplied with the flexible factor compensation coefficient through the multiplication calculation module (MUL) to obtain a power generation load instruction bias signal; an original power generation load fixed value signal is subtracted by the power generation load instruction bias signal through a fourth summation calculation module (SUM4) to obtain a final new power generation load fixed value signal.

* * * * *